United States Patent [19]

Kovacs et al.

[11] Patent Number: 4,596,606

[45] Date of Patent: Jun. 24, 1986

[54] METHOD OF MAKING CG IRON

[75] Inventors: Bela V. Kovacs; Roman M. Nowicki, both of Bloomfield Hills, Mich.

[73] Assignee: Ford Motor Company, Dearborn, Mich.

[21] Appl. No.: 647,333

[22] Filed: Sep. 4, 1984

[51] Int. Cl.[4] ..... C21D 5/00

[52] U.S. Cl. ..... 148/3; 148/35; 148/138

[58] Field of Search ..... 148/35, 3, 138, 141; 75/123 CB

[56] References Cited

U.S. PATENT DOCUMENTS

| | | | |
|---|---|---|---|
| 3,421,886 | 1/1969 | Schelleng | 148/35 |
| 3,549,431 | 12/1970 | Castelet | 148/35 |
| 3,860,457 | 1/1975 | Vourinen et al. | 75/123 CB |
| 4,227,924 | 10/1980 | Subramanian et al. | 75/123 CB |

FOREIGN PATENT DOCUMENTS

| | | | |
|---|---|---|---|
| 90654 | 10/1983 | European Pat. Off. | 75/123 CB |
| 2853870 | 7/1980 | Fed. Rep. of Germany | 148/35 |
| 152149 | 11/1980 | Japan | 75/123 CB |
| 93854 | 6/1983 | Japan | 75/123 CB |
| 753923 | 8/1980 | U.S.S.R. | 148/35 |

OTHER PUBLICATIONS

*Metals Handbook,* Ninth Edition, vol. 1, 1978, ASM, Metals Park, Ohio, pp. 7–8.

*Primary Examiner*—Peter K. Skiff

*Attorney, Agent, or Firm*—Joseph W. Malleck; Roger L. May

[57] ABSTRACT

A method is disclosed for making compacted graphite cast iron of improved strength and hardness while retaining excellent thermal conductivity, low shrinkage, and excellent damping characteristics. A ferrous alloy is melted consisting essentially of, by weight, 3–4% C, 2–3% Si, 0.2–0.7% Mn, 0.25–0.4 Mo, 0.5–3.0% Ni, up to 0.002% sulfur, up to 0.02% phosphorus, and impurities or contaminants up to 1.0%, with the remainder being essentially iron. The melt is subjected to a graphite modifying agent to form compacted graphite upon solidification. The solidified casting is heat treated by austempering and quenching to produce an iron having a matrix of bainite and austenite.

9 Claims, 3 Drawing Figures

599 2HRS@ 1650°F
2HRS@ 725°F 500X 599 2HRS@ 1650°F
2HRS@ 725°F 100X

METHOD OF MAKING CG IRON

TECHNICAL FIELD

The invention relates to the technology of making cast iron and particularly to a method for enhancing the physical characteristics of compacted graphite (CG) cast iron.

BACKGROUND OF INVENTION AND STATEMENT RE PRIOR ART

Compacted graphite (CG) irons exhibit a graphite shape intermediate between that of stringy, interconnected flakes in gray iron and the dispersed, disconnected spheroids in ductile iron. In many ways, CG irons combine the better properties of both gray and nodular iron into one material. The yield strength approaches that of ductile iron while the material retains the machining properties and castability of gray iron. CG irons have been recognized as early as 1966 (see U.S. Pat. No. 3,421,886). However, the introduction of commercial CG iron has been inordinately slow.

The chemistry of CG iron is essentially that of nodular iron except that, in processing, the nodularizing agent, such as magnesium, is either added in smaller proportions or is allowed to fade prior to casting, or Ti is added, so that the graphite formation is changed to that of a compacted configuration as opposed to a spheroid. As used herein, "fade" means a diminution in the effectiveness of the nodularizing agent in accordance with the progression of time. The chemistry of a typical nodular iron is 3.2–4.1% carbon, 1.7–2.8% silicon, 0.45–0.8% manganese, 0.1–0.14% phosphorus, 0.05–0.13% sulfur. In a commercial nodular iron, magnesium is used as a treatment element and is retained in the final casting in an amount of about 0.04% and sulfur is reduced to about 0.002%; in a CG iron, the magnesium may be retained in amount of about 0.01–0.03%.

Gray cast iron is the least expensive of all the cast metals. This is due to the type of raw materials used: pig iron, cast iron scrap, steel scrap, limestone, coke and air, all of which are relatively inexpensive. Gray cast iron is commercially used primarily in the as-cast condition, whereas nodular iron (which requires specialized nodularizing treatment) is used in an as-cast, annealed, or normalized condition and, in some cases, it is quenched and tempered.

It is helpful to compare some of the existing or known physical properties of commercial gray iron and commercial nodular iron with known CG irons which have not been significantly commercialized (see Table 1 below).

TABLE 1

| | Gray Iron | CG Iron | Nodular Iron |
|---|---|---|---|
| Tensile Strength (ksi) | 22–60 | 40–70 | 58–116 |
| Yield Strength (ksi) | — | 33–50 | 36–73 |
| Fracture Elongation (%) (at 2% strain) | 0–.5 | 2–3 | 2–15 |
| Elastic Modulus (million psi in tension) | 11–17 | 20–23 | 23–27 |
| Hardness (BHN) | 140–270 | 140–270 | 140–270 |
| Thermal Conductivity (Cal/cm S °C.) | .12–.16 | .10–.12 | .06–.10 |
| Thermal Expansion (in/in °C. $\times 10^{-6}$) | 11–12 | 12–13 | 11–13 |
| Shrinkage (relative dimensionless unit) | 1 | .9–1.0 | .8–1.0 |
| Damping (relative dimensionless unit) | 1 | .6 | .34 |
| Casting Yield | 60–65% | 55–60% | 50–55% |

It would be extremely desirable if a compacted CG iron could be formulated which continued to exhibit the good physical characteristics of thermal conductivity, shrinkage, and damping similar to that of known CG irons while at the same time have highly improved strength and hardness characteristics approaching that of nodular cast iron. In other words, to approach the combination of characteristics as boxed in Table 1 would be desirable.

The prior art has attempted to increase or optimize certain of the physical characteristics of such iron. In an effort to provide a bainitic/austenitic iron, the prior art has employed the use of certain alloying ingredients, in one case (U.S. Pat. No. 3,860,457) to promote strength characteristic of a bainitic microstructure in nodular iron, and in a second case (U.S. Pat. No. 3,549,431) to promote an increase in thermal expansion in gray iron, also characteristic of a bainitic structure.

In U.S. Pat. No. 3,860,457 a nodular iron was produced (magnesium is 0.03 or greater); the addition of molybdenum and nickel was made to promote pearlite and thereby, in conjunction with the bainite, produce a highly increased strength level. Unfortunately, the use of molybdenum and nickel as pearlite promoters in a nodular iron tends to sacrifice and decrease thermal conductivity, shrinkage and damping, physical characteristics which are of keen interest to this invention. These characteristics are detrimentally injured substantially as a result of the addition of molybdenum and nickel in the amounts recited. It should also be mentioned that molybdenum is generally accepted in the art as a pearlite destroyer during heat treatment, contrary to the teaching of U.S. Pat. No. 3,860,457, and thus the teaching of this patent is suspect.

In U.S. Pat. No. 3,549,431, a gray cast iron was produced which had increased thermal expansion as a result of the addition of elements which included nickel and molybdenum. However, since the thermal expansion proved to be relatively low compared to that of CG irons and, therefore, one cannot deduce that the use of nickel and molybdenum would have any favorable effect upon thermal conductivity, shrinkage or damping now sought to be maintained along with an increase in strength and hardness. In fact, the addition of nickel and molybdenum to a gray cast iron tends to reduce the thermal conductivity, shrinkage and damping characteristics from the levels normally enjoyed with a conventional gray cast iron.

SUMMARY OF THE INVENTION

This invention is a method by which the strength and hardness of CG iron castings can be dramatically increased and, at the same time, maintain the present levels of thermal conductivity, shrinkage and damping characteristics typical of known CG iron. In particular, the method is an economical way of making high strength CG iron parts by essentially alloying the iron melt with nickel, molybdenum and magnesium, and at least one of titanium and/or cerium followed by an austempering heat treatment after solidification.

The method essentially comprises: (a) forming a CG cast iron by melting a ferrous alloy consisting essentially of, by weight, 3–4.0% carbon, 2–3% silicon, 0.2–0.7% manganese, 0.25–0.4% molybdenum, 0.5–3.0% nickel, up to 0.002% sulfur, up to 0.02% phosphorus, and impurities or contaminants up to 1.0%, the remainder being essentially iron; (b) subjecting said melt to a graphite modifying agent in an amount and for a period of time effective to form compacted graphite particles upon solidification; (c) solidifying said melt to form a CG iron casting; and (d) heat treating said iron casting by austempering to produce an iron having a matrix of bainite and austenite.

Graphite modification may be carried out by use of magnesium in an amount that will provide 0.015–0.04% in the casting, and titanium and/or cerium in amounts that will provide in the casting 0.08–0.15%.

Preferably, the molybdenum is maintained at a level of about 0.3% and nickel at a level of about 1.5% to optimize the strength and hardness characteristics. The carbon equivalent for said iron melt is maintained in the range of 4–4.75; Cu may be added in an amount of 0.4–1.9% to maintain the carbon in the matrix of the casting microstructure. Advantageously, the austempering treatment involves heating to an austenitizing temperature of 1500°–1700° F., holding the melt at said temperature for 0.5–4 hours, and tempering by cooling in a low temperature salt bath to a temperature level of 450°–800° F., holding at the latter temperature for 0.5–4 hours, then cooling to room temperature.

The composition resulting from the practice of the above method is essentially bainitic/austenitic compacted graphite cast iron consisting essentially of 3.0–4.0% carbon, 2–3% silicon, 0.2–0.7% manganese, 0.01–0.02% magnesium, 0.25–0.4% molybdenum, 0.5–3.0% nickel, sulfur up to a maximum of 0.002%, and phosphorus up to a maximum of 0.02%, 30% austenite, and 70% bainite. The composition has a tensile strength of 100–130 ksi, yield strength of 85–110 ksi, a shrinkage characteristic significantly less than nodular iron, and the ability to be cast in a thin wall casting of down to 0.06 inches thick.

DETAILED DESCRIPTION

Developmental CG irons are commonly produced by the use of commercial graphite modifiers in the form of magnesium or cerium, the latter being made as additions in very small, regulated amounts to the melt prior to solidification. When the magnesium or cerium content in the solidified structure is above about 0.025%, nodular graphite usually precipitates. Flake graphite is formed at magnesium concentrations below about 0.015%. Accordingly, with magnesium or cerium concentrations in the range of 0.015–0.025%, compacted graphite (otherwise sometimes referred to as vermiculite) will precipitate. The addition of titanium to magnesium or cerium treated irons makes it possible to produce compacted graphite irons in both medium and heavy castings at higher magnesium or cerium concentrations. The presence of titanium reduces the amount of control required on the magnesium concentration and is of considerable benefit in compacted graphite formation. Thus, with a magnesium addition containing titanium, compacted graphite will form with magnesium or cerium concentrations in the range of 0.015–0.035%, possibly even up as high as 0.04%.

The invention herein provides a method by which a CG iron can be modified to increase the strength and hardness values above that obtained with conventional processing while at the same time preserving the level of shrinkage, thermal conductivity, and damping characteristics normally enjoyed with a conventional compacted graphite iron. To this end, the method of this invention essentially comprises: (a) casting an iron alloy melt into substantially the shape of the desired part, the melt consisting essentially of, by weight, 3.0–4.0% carbon, 2.0–3.0% silicon, 0.2–0.7% manganese, 0.25–0.4% molybdenum, 0.5–3.0% nickel, and no greater than 0.002% sulfur and 0.02% phosphorus, with impurities up to 1% and the remainder iron, said melt having been subjected to graphite modifying agent to form compacted graphite particles upon solidification; and (b) heat treating the cast part to provide an austempered bainitic/austenitic compacted graphite microstructure having 30% austenite and 70% bainite, with 12% by volume compacted graphite being present. The cast part will have a tensile strength of 100–130 ksi, a yield strength of 85–110 ksi, a fracture elongation of 5–7%, a hardness of 240–320 BHN, a thermal conductivity of 0.1, a damping characteristic having a ratio of 0.6, and a shrinkage significantly less than nodular iron when cast into a thin wall of about 0.06 inches.

Figure 2:
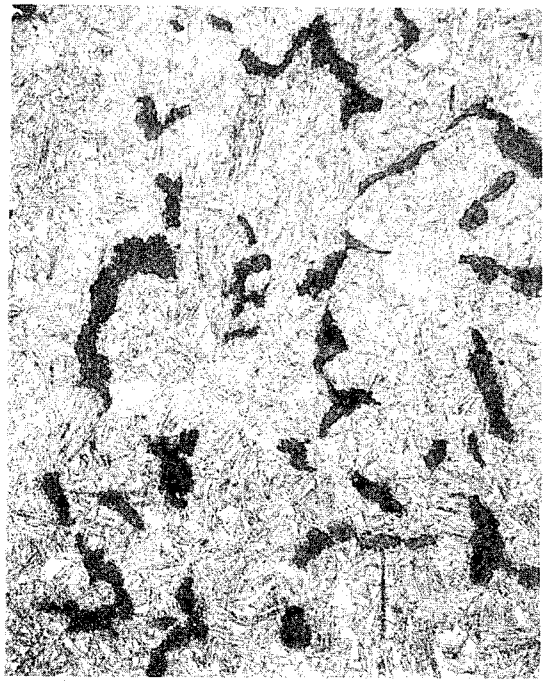
FIGS. 1 and 2 are photomicrographs (respectively 100X and 500X) of solidified bainitic/austenitic compacted graphite irons made in accordance with this invention.
Figure 1:
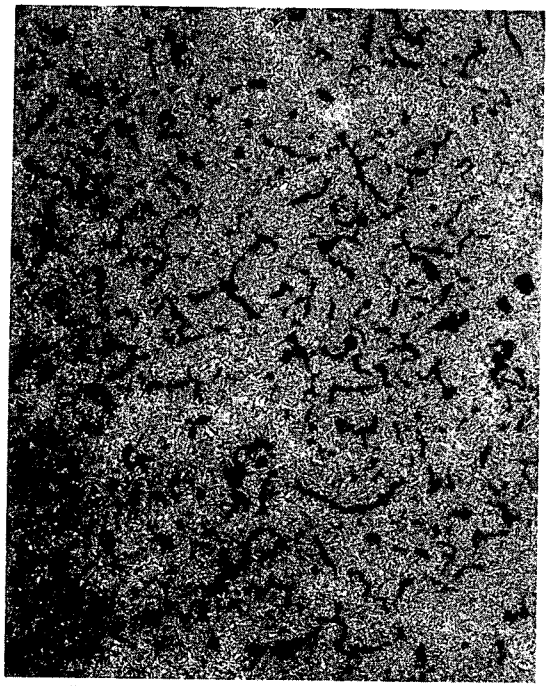
Figure 3:
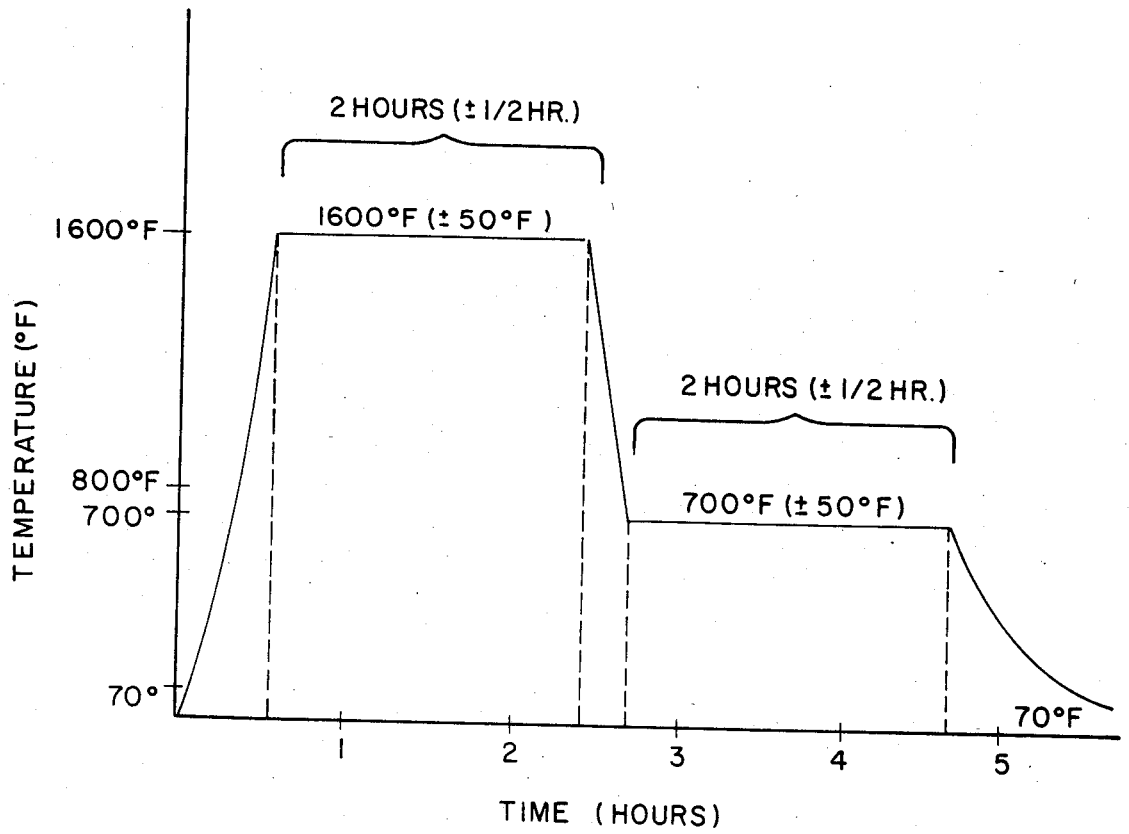
FIG. 3 is a graphical illustration of thermal treatment used to produce the iron of FIGS. 1 and 2.

The melting is typically performed in a furnace heated to 2800°–2850° F., and then teamed into a treating ladle at a temperature of about 2750° F. Alloying elements are added to the treating ladle along with graphite modifiers in the form of magnesium and titanium. Commercial graphite modifying agents may comprise (a) rare earth elements added to a desulfurized iron, or (b) Mg and Ti added prior to post-inoculation (slightly higher base sulfur can be used). Mg is used in an amount to provide 0.015–0.04% in the casting and Ti is used in an amount to provide 0.08–0.15% in the casting. The treated melt is then poured into one or more pouring ladles, and at each of the pouring ladles a post-inoculant in the form of ferro-silicon or ferro-silicon with aliminum and calcium is added. The melt is then poured into molds at a temperature in the range of 2500°–2600° F. and the mold cooled without any special cooling treatment. The graphite modifying agent may be added in a commercially available form which typically has a composition of 52% silicon, 10% titanium, about 0.9% calcium, 5% magnesium, 0.25% cerium, the modifier is added in an amount of about 0.5% of the total melt. The post-inoculant added to the pouring ladle comprises ferro-silicon or titanium bearing ferro-silicon added in an amount of about 0.5%. Thermal treatment of the solidified or cast melt is shown in FIG. 3.

Copper may be added to the melt in an amount of 0.4–1.9% to maintain the carbon in the matrix of the casting microstructure. It is preferred that the melt chemistry be maintained at optimum percentages, including about 3.6% carbon, about 2.7% silicon, about 0.3% manganese, about 0.02% magnesium, about 0.1% titanium, about 0.7% copper, about 0.3% molybdenum, and about 1.5% nickel.

This method provides the ability to obtain higher strength and hardness values for a compacted graphite iron while at the same time preserving the thermal conductivity, shrinkage and damping characteristics normally obtained. The importance of this contribution is made clear by reference to Table II, which presents physical characteristics obtained for various iron samples to compare conventional compacted graphite iron (sample 1) which had been subjected to an austenitizing and tempering treatment, and samples 2–6 wherein Ni and Mo had been added in varying amounts to gray iron and given the indicated austemper treatment. Table I also compares the addition of nickel and molybdenum to a conventional gray iron melt (sample 7) as well as to a conventional nodular iron melt (sample 8), and one sample (sample 9) compares the elimination of the austempering treatment. Improved physical characteristics are not obtained except when a critical amount of nickel and molybdenum is added to a compacted graphite iron and subjected to an austempering treatment as previously disclosed. Each of the samples was prepared with a base chemistry of 3.6% carbon, 2.5% Si, 0.5% Mn, 0.01% phosphorus, 0.001 sulfur. The melt was heated in accordance with the preferred mode and cast at a pouring temperature of 2550° F. Each casting was subjected to a heat treatment as indicated in Table I at temperatures listed.

It can be seen from Table II that sample 2, representing the CG iron invention herein, obtained a tensile strength level of 110 ksi, a yield strength of 90 ksi, a hardness of 285 BHN, along with a thermal conductivity of 0.1–0.12 Cal/cm S° C., a shrinkage value of 0.9–1.0, and a damping characteristic of 0.6. A similar conventional gray iron, sample 1, without the presence of nickel and molybdenum, obtained only a tensile strength level of 50–80 ksi, a tensile strength of 42–70 ksi, an elongation of only 3%, a hardness level of 140–270 BHN, and a thermal conductivity retained at 0.1–0.12, and the excellent shrinkage damping characteristics of conventional CG iron were also retained. Sample 2 had a mixture of pearlite, austenite and bainite. When a conventional nodular iron, sample 8, contained nickel and molybdenum amounts similar to that used in the invention herein, the thermal conductivity, shrinkage and damping characteristics suffered in that they dropped to lower levels.

When insufficient Mo was added, sample 3, the casting suffered in that only pearlite was formed accompanied by lower strength and elongation. When insufficient Ni was added, sample 5, the casting contained pearlite again accompanied by poorer elongation. When excess Mo or Ni was added, samples 4 and 6 respectively, the casting suffered in that martensite was formed accompanied by much poorer elongation in 4 and lower strength levels in 6. Sample 9 illustrates the significant reduction in thermal conductivity, increased shrinkage, and poorer damping when the austemper treatment is eliminated.

TABLE II

| Sample | Additive to Gray Iron | Graphite Modifier | Austemper | Tensile Strength (ksi) | Yield Strength (ksi) | Elongation (%) | Hardness (BHN) | Thermal Conductivity (Cal/cm S °C.) | Shrinkage (Relative Unit) | Damping (Relative Unit) |
|---|---|---|---|---|---|---|---|---|---|---|
| 1 | None | .02 Mg .1 Ti | Yes | 50–80 | 42–70 | 3 | 140–270 | .1–.12 | .9–1.0 | .6 |
| 2 | .3 Mo 1.5 Ni | .02 Mg .1 Ti | " | 110 | 90 | 6 | 285 | " | " | " |
| 3 | .1 Mo 1.5 Ni | .02 Mg .1 Ti | " | 100 | 80 | 4 | 280 | " | " | " |
| 4 | 1.0 Mo 1.5 Ni | .02 Mg .1 Ti | " | 100–140 | 130 | 1 | 330 | " | " | " |
| 5 | .3 Mo .1 Ni | .02 Mg .1 Ti | " | 100 | 80 | 3.5 | 275 | " | " | " |
| 6 | .3 Mo 5.0 Ni | .02 Mg .1 Ti | " | 105 | 85 | 9 | 270 | " | " | " |
| 7 | .3 Mo 2.0 Ni | None (gray iron) | " | 55–60 | — | .5 | 260 | .12–.16 | 1 | 1 |
| 8 | .3 Mo 1.5 Ni | .05 Mo 0 Ti | " | 150 | 115 | 10 | 275 | .06 | .8 | .3 |
| 9 | .3 Mo 1.5 Ni | .02 Mg .1 Ti | No | 70 | 50 | 2.3 | 230 | " | " | " |

We claim:

1. A method of making compacted graphite iron, comprising:

(a) forming a ferrous alloy melt consisting essentially of, by weight, 3–4.0% carbon, 2–3% silicon, 0.2–0.7% manganese, 0.25–0.4% molybdenum, 0.5–3.0% nickel, up to 0.002% sulfur, up to 0.02% phosphorus, and impurities or contaminants up to 1.0%, the remainder being essentially iron, said melt being subjected to a graphite modifying agent in an amount and for a period of time effective to form compacted graphite particles upon solidification;

(b) solidifying said melt to form a CG iron casting; and (c) heat treating said iron casting by austempering to produce an iron having a matrix of bainite and austenite.

2. The method as in claim 1, in which said melt is heated to a temperature of 2800°–2850° F. prior to solidification.

3. The method as in claim 1, in which said graphite modifying agent to which said melt is subjected comprises magnesium in an amount that will provide 0.015–0.035% of said agent in the casting.

4. The method as in claim 3, in which said graphite modifying agent also includes titanium in an amount of 0.1–0.15% permitting said magnesium to be present up to 0.4%.

5. The method as in claim 1, in which said Mo is present in an amount of about 0.3% and Ni about 0.5%.

6. The method as in claim 3, in which copper is additionally added to said melt in the range of 0.4–1.9%, said copper being effective to maintain the carbon in the matrix of the casting microstructure.

7. The method as in claim 1, in which said melt has a carbon equivalent in the range of 4–4.75%.

8. The method as in claim 1, in which said austempering heat treatment is carried out by heating the casting to an austenitizing temperature in the range of 1500°–1700° F., maintaining said temperature for a period of 0.5–4 hours, quenching the casting in a salt bath to a temperature level of 400°–800° F. for a period of 0.5–4 hours, and then cooling the casting to room temperature.

9. The composition resulting from the practice of claim 1, in which magnesium is used as the graphite modifying agent, said composition being characterized by a bainitic/austenitic compacted graphite iron consisting essentially of 3.0–4.0% carbon, 2–3% silicon, 0.2–0.7% manganese, 0.01–0.02% magnesium, 0.25–0.4% molybdenum, 0.5–3.0% nickel, sulfur up to 0.002%, phosphorus up to 0.02%, the matrix having 30% austenite and 70 % bainite, said composition exhibiting a tensile strength of 110–130 ksi, yield strength of 85–110 ksi, a shrinkage characteristic significantly less than that of nodular iron, and the ability to be cast in a thin wall configuration of about 0.06 inch thick.

* * * * *